United States Patent [19]

Horton

[11] Patent Number: 4,492,270

[45] Date of Patent: Jan. 8, 1985

[54] METHOD OF INSTALLING AND USING OFFSHORE WELL DEVELOPMENT AND PRODUCTION PLATFORMS

[75] Inventor: Edward E. Horton, Rancho Palos Verdes, Calif.

[73] Assignee: Global Marine, Inc., Los Angeles, Calif.

[21] Appl. No.: 251,112

[22] Filed: Apr. 6, 1981

Related U.S. Application Data

[63] Continuation-in-part of Ser. No. 146,360, May 2, 1980, abandoned.

[51] Int. Cl.[3] ..... E02B 17/02; E21B 43/01

[52] U.S. Cl. ..... 166/358; 405/196; 405/204; 405/227; 405/228

[58] Field of Search ..... 405/196, 203, 204, 209, 405/227, 228; 175/9; 166/358

[56] References Cited

U.S. PATENT DOCUMENTS

| | | | |
|---|---|---|---|
| 3,001,595 | 9/1961 | Lucas | 175/9 |
| 3,633,369 | 1/1972 | Lawrence . | |
| 3,729,940 | 5/1973 | Koehler | 405/227 X |
| 3,859,806 | 1/1975 | Guy et al. . | |
| 3,999,396 | 12/1976 | Evans | 405/196 |
| 4,014,567 | 3/1977 | Arnold et al. . | |
| 4,027,493 | 6/1977 | Guy . | |
| 4,161,376 | 7/1979 | Armstrong . | |
| 4,269,542 | 5/1981 | Mueller | 405/196 |

*Primary Examiner*—David H. Corbin

*Attorney, Agent, or Firm*—Christie, Parker & Hale

[57] ABSTRACT

A development and production facility for an offshore oil or gas field is constructed and drilling of wells is performed using a jack-up drilling platform in an improved manner. The facility is composed of a development well platform and a production platform, each of which is composed of a modular prefabricated unitary deck assembly of substantially turn-key completeness and of a prefabricated jacket or leg assembly to which the deck assembly is matable. Crane or derrick barges are used only to position the deck assemblies on the leg or jacket assemblies after the latter assemblies have been placed erect on and secured to the sea floor by use of the jack-up platform. The development well platform is constructed first so that drilling of development wells can be performed from the jack-up platform through the former platform concurrently with the placement and completion of the production platform.

9 Claims, 8 Drawing Figures

23
50
52
54a
54b
58
60
62
64
66
68
70
72
74
76
7

METHOD OF INSTALLING AND USING OFFSHORE WELL DEVELOPMENT AND PRODUCTION PLATFORMS

CROSS-REFERENCE TO RELATED APPLICATIONS

This application is a continuation-in-part of application Ser. No. 146,360 filed May 2, 1980, now abandoned, which is incorporated herein by this reference.

FIELD OF THE INVENTION

This invention pertains to the drilling and production of hydrocarbon fluids, liquids, and gases from offshore locations in water depths compatible with the use of jack-up drilling platforms. More particularly, it pertains to improved methods for installing and operating drilling and production towers at offshore locations by use of a jack-up drilling rig.

BACKGROUND OF THE INVENTION

Review of the Prior Art

In the U.S. Gulf Coast margin area, as from the Mississippi River to Corpus Christi, Tex., as well as in other areas of the world, notably in Indonesia, there are located substantial subsea reserves of oil and gas below waters of from 25 to 150 feet deep. In such depths of water, jack-up drilling platforms are usable with particular economic advantage. In many of these areas, the hydrocarbon reserves, notably gas reserves, are of such nature as to be regarded as of marginal economic nature when evaluated in the context of presently available development and production techniques and equipment. Because of the economically marginal nature of these reserves, they are not being considered for development and production. However, if improved procedures for the fabrication, installation, and operation of offshore development and production facilities can be provided, the economic potential of these reserves will be enhanced, thereby encouraging the production of the substantial hydrocarbon reserves which there exist.

A need exists for the development of new procedures and techniques for the expeditious and efficient fabrication, installation, and operation of development and production facilities offshore in areas now considered to be of marginal economic nature. If this need can be satisfied, then economic incentives would exist for the production from these reserves of the hydrocarbons which are known there to exist, but which have not been tapped because of the uneconomic aspects of present procedures. Development of these oil and gas fields will contribute substantially to an improvement in the present worldwide supply of these resources which are now in short, if not critical, supply in many areas.

SUMMARY OF THE INVENTION

This invention provides improved procedures and techniques for the speedy and economic fabrication, installation, and completion of offshore oil and gas development and production structures. These improvements preferably are practiced in combination with the use of a jack-up drilling rig. Thus, these improvements are of particular utility in the context of offshore oil and gas fields lying below water depths in the range of 25 to 150 feet or so. The procedural improvements provided by this invention enable offshore completion and production facilities to be erected and placed in operative condition rapidly, economically, and effectively. The improved procedures make possible the movement and reuse of equipment after a given subsea oil or gas field is depleted, thereby further enhancing the economic benefits provided by the invention. The improved procedures make maximum use of existing offshore drilling equipment, thereby enabling the procedures to be put into practice rapidly.

Generally speaking, this invention provides a method for installing and using an offshore well completion platform in water having a depth suitable for use of a jack-up drilling platform. The method comprises the step of prbviding a jack-up drilling platform which carries thereon a drilling rig movable horizontally on a base platform of the jack-up platform having an operative position in a drilling operations area outboard of an elevatable base of the platform. The jack-up drilling platform, as so provided, also includes a crane on the base adjacent the perimeter of the base and proximate the operative position of the drilling rig. Another step of the method involves positioning the jack-up platform at an offshore location with the base elevated above the water surface so that the drilling operations area of the jack-up platform is located vertically over a submerged location on the sea floor at which at least one subsea oil or gas well is to be drilled. A further step of the method comprises moving to the offshore location a prefabricated well protector jacket assembly having a length sufficient to extend from the submerged location to above the water surface, such length, however, being insufficient to extend to the elevation of the drilling rig when the drilling rig is in its operative position. A further step comprises setting the well protector jacket assembly in an erect attitude on the sea floor over the submerged location; the jacket assembly is then secured to the sea floor. A complete prefabricated wellhead deck assembly, matable with the upper end of the secured jacket assembly, is then moved to the site of the secured well protector jacket assembly. A further step includes mating the deck assembly securely to the jacket assembly below the operative position of the drilling rig; in this manner, there is defined, independently of the jack-up platform, a completed development wellhead platform above the water surface and below the operative position of the drilling rig. The drilling rig is then used in its operative position to drill at least one well through the wellhead platform into the sea floor. A further step in the method involves completing each well so drilled by use of equipment carried by the prefabricated wellhead deck assembly.

A further aspect of this invention includes the further steps of moving to the operative position of the jack-up platform a production platform leg assembly having a length substantially equal to that of the well protector jacket assembly. The leg assembly is set in an erect attitude on the sea floor adjacent to the location of the secured jacket assembly and is secured to the sea floor. Next, a complete prefabricated production platform deck assembly, matable with the upper end of the secured leg assembly, is moved to the site of the secured leg assembly and is securely mated to the leg assembly to define a complete production platform.

In one embodiment of this invention, the jacket assembly and leg assembly, which are similar and are termed support assemblies for purposes of exposition herein, each comprise a plurality of prefabricated nodes connected together by structural support members. Each such node comprises a plurality of connection points for the support members and has substantially the same geometrical configuration as each other prefabricated node used.

DESCRIPTION OF THE DRAWINGS

The above mentioned and other features of this invention are more fully set forth in the following detailed description of the presently preferred embodiment of this invention; such description is set forth with reference to the accompanying drawings, wherein:

FIG. 8 also illustrates certain sequential relations between the various procedural steps.

DESCRIPTION OF THE ILLUSTRATED EMBODIMENT

Present economic conditions pertinent to the development and production of gas from shallow water (25 to 150 foot water depth) offshore gas fields are such as to make production facilities having a shortlived capacity of less than 50 MMscf/day of marginal appeal. This invention provides procedures and techniques which make it economically attractive to erect and operate gas development wells and production facilities offshore in such water depths and for such daily production rates. Further, these procedures make maximum use of existing offshore drilling equipment and techniques so as to enable the construction, erection, and commencement of operations of offshore gas well development drilling and production facilities in minimum time and with minimum use of costly support equipment.

Workers skilled in the art to which this invention pertains will recognize that, while the following description of the presently preferred embodiment of this invention is presented with reference to a gas production facility, this invention is also useful in the production of offshore oil reserves. Such persons will also recognize that the improved systems and procedures provided by the present invention can be used to advantage in developing and producing subsea hydrocarbon reserves generally and that the utility of this invention is not limited to use in situations of marginal economic attractiveness.

Figure 8:
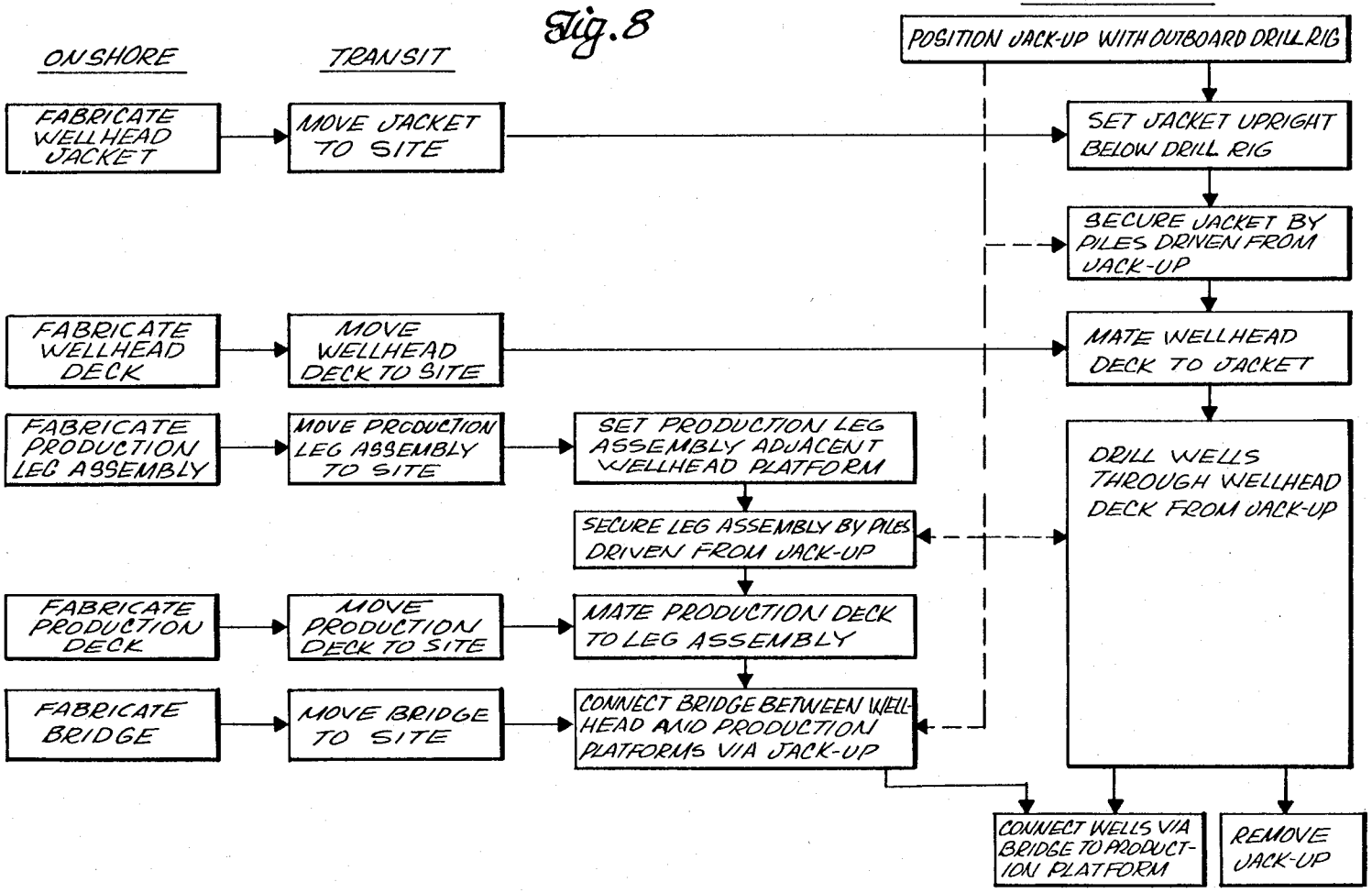
FIG. 8 is a block diagram which shows the relation between the various steps in the preferred procedure for erecting and operating the offshore development and production facility.

FIG. 8, a block diagram of the various steps involved in the procedural aspects of this invention, has general pertinence to the following descriptions of this invention. Therefore, general familiarity with FIG. 8 will enhance understanding of the following descriptions.

The broken line in FIG. 8 signifies that the operations described in the boxes to which the broken line extends are operations which are performed, at least in part, by use of equipment located above the jack-up drilling platform. Thus, FIG. 8 schematically indicates that the pile driving operations pursued to secure the wellhead jacket and the production leg assembly are performed using equipment on the jack-up, the wells are drilled through the wellhead desk from the jack-up, and the procedures followed to connect the bridge between the wellhead and production platforms are procedures which involve use of equipment located on the jack-up.

Figure 1:
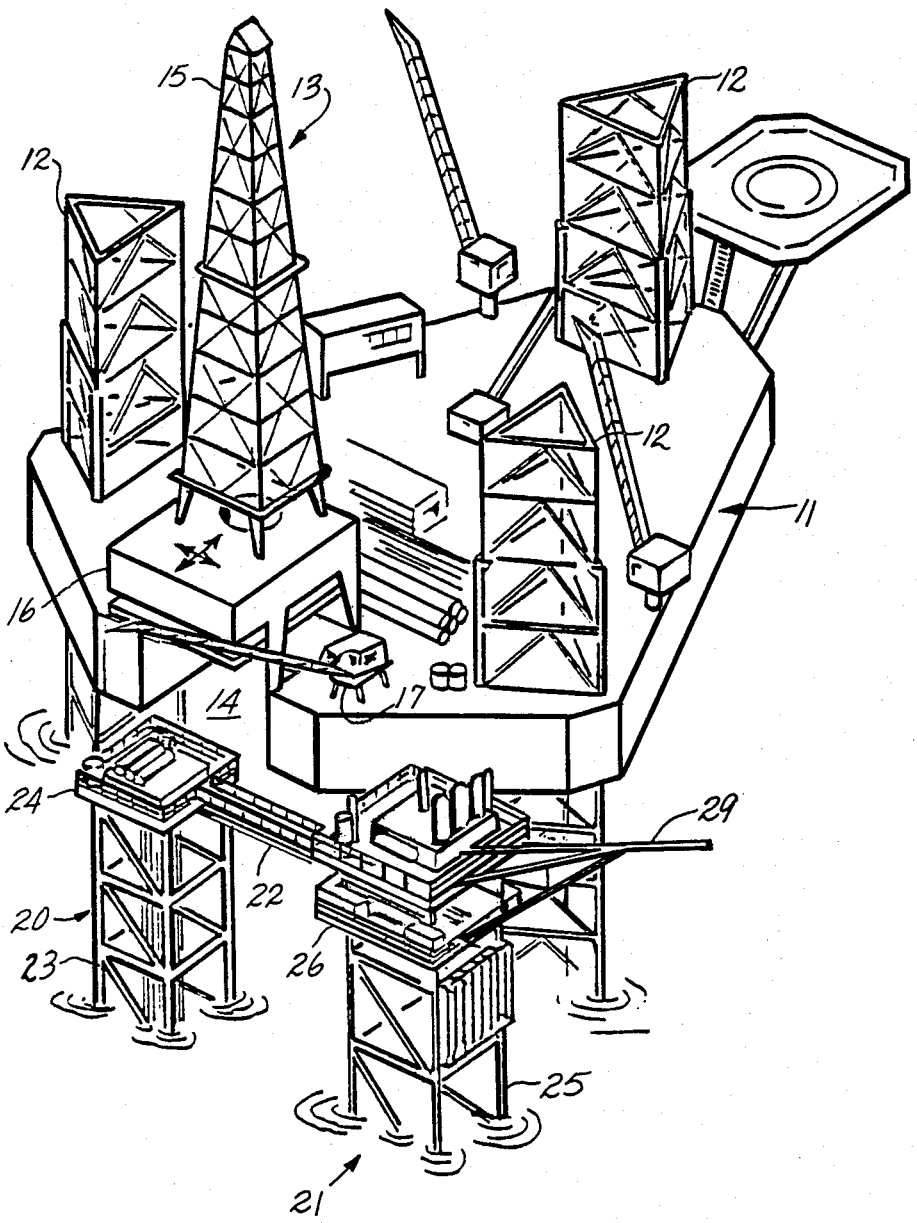
FIG. 1 is a perspective view of a completed offshore development and production facility showing the relationship of a jack-up drilling platform to the facility.

Referring to FIG. 1, to develop an offshore gas field, a self-elevating drilling unit 10 is used to advantage. Drilling unit 10 is a jack-up drilling platform having features similar to those encountered in the GLOMAR Jack-Ups I and II, owned and operated by Global Marine, Inc. Such jack-up drilling platforms include a buoyant base 11 of generally triangular platform configuration carrying three jack-up legs 12, one at each corner of the base. Suitable jacking mechanisms are provided and are operative between the base and the jack-up legs. The jack-up platform can be towed to a site of intended use using base 11 as a buoyant hull. During towing of the platform to a site of use, legs 12 are raised by the jacking mechanisms relative to the base so that the lower ends of the legs are either within the vertical extent of the base or do not extend substantially below the base. When the platform has reached its site of intended use, legs 12 are lowered from the base until they firmly engage the sea floor. Continued operation of the jacking mechanisms causes the jack-up platform base to be raised to a suitable elevation above the water surface. The elevated base is then secured to the legs and offshore drilling operations may then be commenced using a drilling rig 13 which is carried by the base.

Drilling platform 10, as shown in FIG. 1, has a base which defines a notch 14 of substantial area extending inwardly toward the center of the base from the perimeter of the base. The drilling rig 13 includes a derrick 15 which is supported on a rig floor structure 16 which is movable between an operative drilling position over notch 14 (shown in FIG. 1) and a stowed position (for towing of the platform) substantially more centrally of the area of base 11. Also, the portion of the drilling rig 13 which includes derrick 15 and the associated rotary drilling table below the derrick is movable relative to base 11 a limited amount (say, about 10 feet) in either direction transversely of the direction of movement of the rig between its operative and stowed positions. Thus, jack-up platform 10 is adapted for drilling from a basic established position of the jack-up platform a plurality of wells having closely spaced wellheads.

An important feature of the jack-up drilling platform, in the context of this invention, is the ability to position the drilling rig effectively outboard of the actual perimeter of the platform base. Thus, to be well suited for use in the practice of this invention, a jack-up platform should either be of the general configuration of platform 10, shown in FIG. 1 (i.e., having a drilling rig disposable over a notch in the perimeter of the platform base) or the drilling rig should be positionable in cantilever fashion in a drilling position outboard of the perimeter of the base.

Also, to be well suited to the practice of this invention, the jack-up drilling platform also includes a crane 17 or the like mounted closely adjacent the perimeter of the platform base, close to the operative drilling position of the drilling rig. Crane 17 preferably has a 50 ton capacity at 60 foot radius.

With reference to jack-up platform 10 (shown in FIG. 1), the area encompassed by notch 14 is referred to as a drilling operations area which is effectively outboard of the elevatable base of the jack-up platform; drilling rig 13 has an operative drilling position over the drilling operations area.

Jack-up platform 10 is used at a desired offshore location to accomplish substantial aspects of the placement, installation, and completion of a development platform 20 and an adjacent production platform 21 which are interconnected by a bridge structure 22. The development platform is composed principally of a jacket assembly 23 and a deck assembly 24. Similarly, the production platform is composed principally of a jacket assembly 25 and a deck assembly 26. (To avoid confusion between the jacket assemblies of the development platform and the production platform, the term "jacket assembly" is used hereinafter with reference to the structure which supports the development platform deck assembly, and the term "leg assembly" is used hereinafter to refer to the structure which supports the production platform deck assembly. Both assemblies can be referred to as "support assemblies".)

The jacket assembly and deck assembly of development well platform 20 are prefabricated separately as distinct modular components of the platform. Deck assembly 24 is fabricated as a module complete with manifolding equipment and the like downstream of the Christmas trees, so that, when the deck assembly is mated and secured to its supporting jacket assembly, platform 20 is complete and ready for producing at least one, and preferably a plurality, of development gas wells through the platform. Jacket assembly 23, as prefabricated, has a length sufficient to extend from engagement with the sea floor at the intended well site to a point above the water surface. Deck assembly 24 is fabricated in such manner that, when it is mated to the upper end of the jacket assembly, the upper end of platform 20 is below the operative drilling position of rig floor structure 16 at the drilling operations area associated with jack-up platform 10.

Jacket assembly 23 and deck assembly 24 can be, and preferably are, fabricated concurrently with each other. These components of platform 20 can be constructed in separate onshore facilities; the jacket assembly can be constructed by a firm and at a site best suited for this type of construction, whereas the deck assembly can be constructed by a separate firm having other facilities more suited for the construction of this type of structure. Similarly, the leg assembly and the deck assembly of production platform 21 can be, and preferably are, constructed simultaneously and, if desired, at separate locations best suited for these different types of construction.

The procedural aspects of this invention include the initial step of providing a jack-up drilling platform having the essential characteristics described above as to platform 10. Thus, as provided, the jack-up drilling platform has thereon a drilling rig which has an operative position in a drilling operations area outboard of the elevatable base of the jack-up platform. As provided, the jack-up drilling platform also includes a crane adjacent the perimeter of the base and proximate the drilling rig operative position. The jack-up platform is positioned at a desired offshore location with the base of the jack-up platform elevated above the water surface so that the drilling operations area is located vertically over a submerged location on the sea floor at which at least one subsea gas well is to be drilled.

In anticipation of the positioning of the jack-up drilling platform at the desired offshore location as described above, the construction of the jacket, leg, and deck assemblies of platforms 20 and 21 are carried out at suitable onshore locations. The construction of the jacket assembly and the leg assembly, i.e., the support assemblies, are similar and thus the preferred construction sequence of only the jacket assembly 23 is described in detail.

Figure 6:
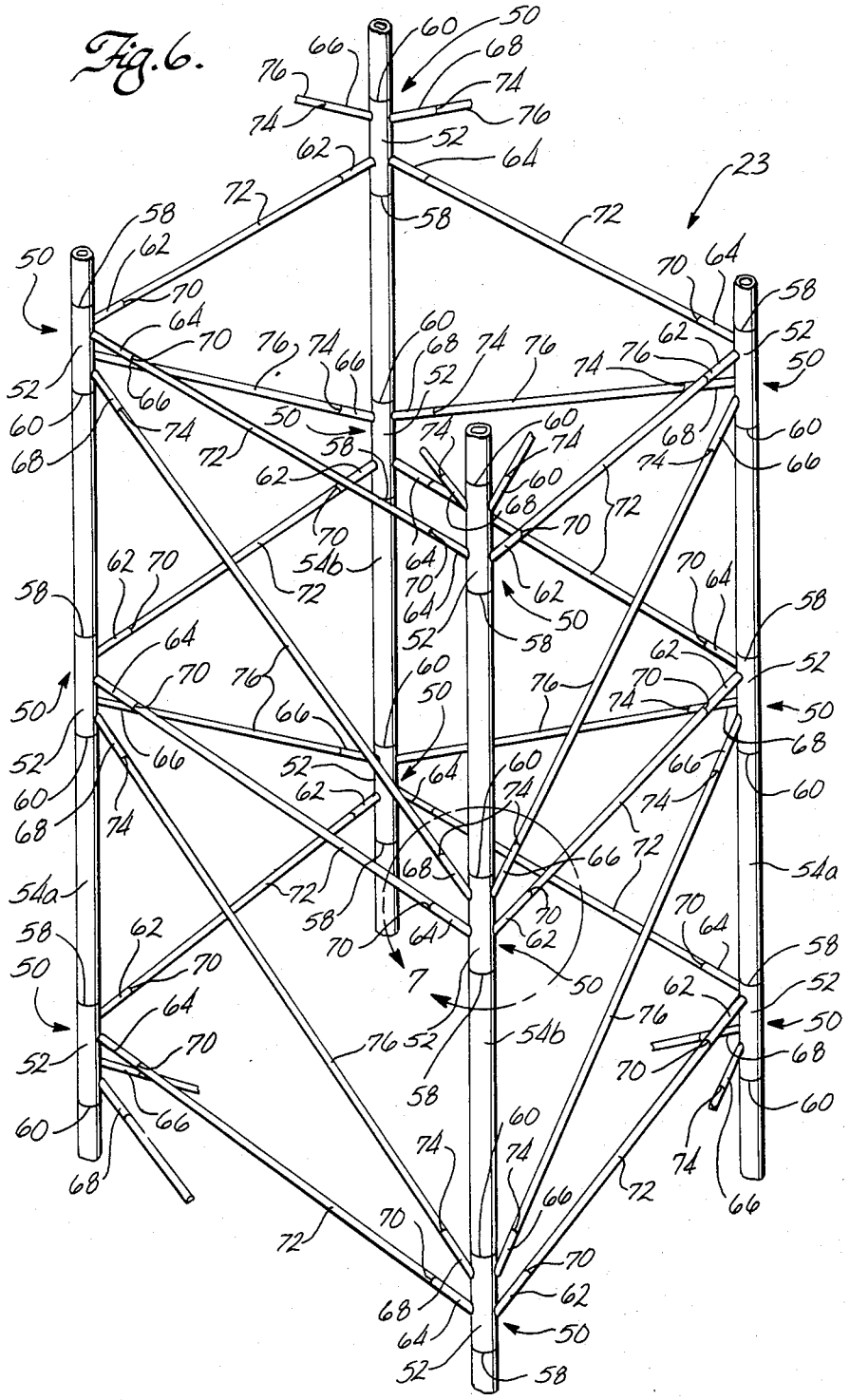
FIG. 6 is a fragmentary perspective view of a support assembly for use as a base of a development and/or a production platform in accordance with this invention.
Figure 7:
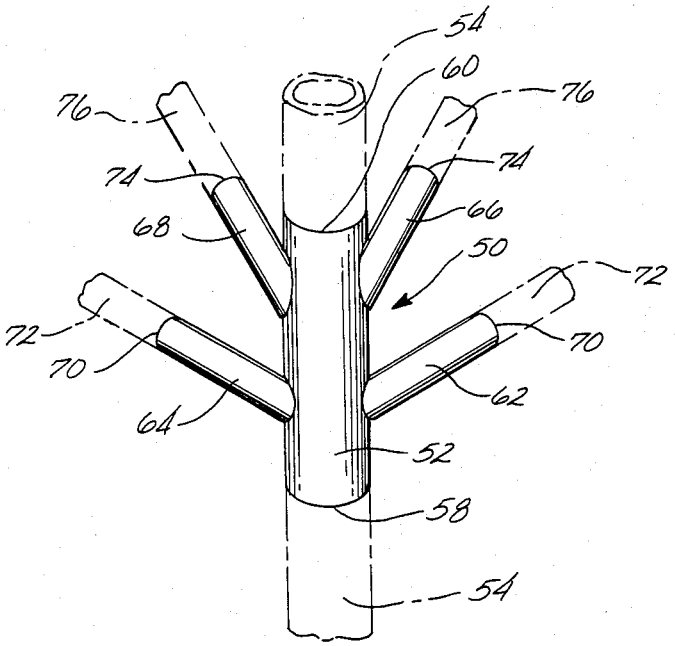
FIG. 7 is a fragmentary perspective view of a node provided in accordance with this invention, enclosed within line 7 of FIG. 6.

In an exemplary embodiment, as can best be understood by referring to FIGS. 6 and 7, the support assembly, in this instance the jacket assembly 23, is constructed by connecting support members between a plurality of prefabricated nodes 50. Preferably, the support members are steel tubes, but if desired, steel formed in other cross-sectional configurations can be used. Also, it is preferred that nodes 50 be fabricated of steel tubes; if desired, however, the nodes can be castings. In one embodiment, each prefabricated node 50 is the same size and has the same geometrical configuration as each other node used for the construction of the jacket assembly. When identical nodes are used, the economics of construction of the jacket assembly is enhanced because standard jigs can be used and the most complex parts of the assembly, namely the nodes, can be prefabricated to close tolerances. Additionally, the economics of the operation are enhanced because quality control of the operation is improved.

Although, in this embodiment, each node 50 comprises six connection points to which support members are welded or otherwise suitably connected, standard prefabricated nodes having a different number of connection points can be used. The number of connection points defined by each node can depend on the design configuration of the support members in the jacket assembly and upon the overall truss arrangement used, preferably repetitively, in the jacket assembly.

Each node includes an elongated tubular central member 52 (best shown in FIG. 7) which provides two coaxially aligned connection points for connection of vertical structural members, i.e., the vertical legs 54, of the jacket assembly. A first connection point 58 is at one end of the node central member and a second connection point 60 is at its other end. The connection points are shown in FIGS. 6 and 7 as weld lines where each connection point of the node is welded to a vertical or to a diagonal support member.

Each node also comprises elongated tubular first, second, third, and fourth members 62, 64, 66, and 68, respectively, each of which is connected to the central node member 52. The first and second node members 62 and 64 are each connected, preferably by welding, to the node central member 52 nearer to end 58 of member 52 than to end 60; the ends of members 62 and 64 not connected to the central member define connection points 70 for connection to the node of horizontal structural members 72 of the jacket assembly. The axes of the first and second node members are at right angles to each other and to the axis of the node central member 52. Thus, if the axis of node central member 52 (as seen in FIG. 7) is the Z axis, the axes of node first and second members 62 and 64 are aligned along X and Y axes, respectively.

The node third and fourth members 66 and 68 are each connected, preferably by welding, to the node central member 52 between members 62 and 64 and end 60 of the central member; the ends of these members not connected to the central member define connection points 74 for connection to the node of respective ones of the diagonal support members 76 of the jacket assembly. The longitudinal axis of the node third member 66 is in the same plane as the axes of the node first and central members 62 and 52, whereas the longitudinal axis of the node fourth member 68 is in the same plane as the axes of the node second and central members 64 and 52. The angle between the axes of the node third and central members is about equal to the angle between the axes of the node fourth and central members. These angles need not be, but preferably are, equal and have a value of 45° such that a plurality of nodes 50 are useful to fabricate the jacket assembly which is "square", i.e., the assembly legs are at the corner of a square.

In the exemplary jacket assembly 23 shown in FIG. 6, the nodes are used in a first attitude in two of the jacket legs 54*a*, which are at diagonally opposite corners of the jacket assembly's square platform configuration, and at second attitudes, inverted relative to the first attitude, in the two remaining jacket legs 54*b*. In other words, nodes 50 provided in accordance with practice of this invention and having uniform geometry are used as major components to construct the entire jacket assembly. Thus, as is apparent from an inspection of FIG. 6, in each vertical leg of the jacket assembly, all nodes are used in the same attitude which is opposite to the attitude in which the nodes are used in each immediately adjacent vertical leg; connection point 58 of one node is connected to preferably identical connection point 60 of the next adjacent node via a suitable, preferably tubular, support member. At each vertical station (level) along the height of the jacket assembly, the first and second members 62 and 64 of each node are connected to corresponding members of each next adjacent node via connection points 70 and suitably sized support members 72 which can be, and normally are, different in size from the vertical leg support members. Similarly, the third and fourth members 66 and 68 of each node are connected to corresponding members of the next higher or lower levels of the next adjacent legs via connection points 74 and suitably sized diagonal support members 76 which can be different in size from horizontal support members 72.

Because the several nodes 50 of leg assembly 23 are all geometrically similar to each other, and may be identical to each other at their respective connection points 58 and 60, 70 and 74, it will be seen that the vertical 54, horizontal 72, and diagonal 76 support members, respectively, are of equal length. Thus, the different types of support members can all be cut to predetermined lengths, if desired, at a mill or other location different from the location at which the support members and nodes are interconnected to define the jacket assembly.

Jacket assemblies constructed in accordance with this invention preferably are square in horizontal cross-section. However, when using a plurality of nodes of the above described configuration, jackets having larger or smaller horizontal cross-sections can be constructed as desired.

In some embodiments, the support members of a jacket assembly desirably increase in size from the top of the jacket to the bottom. In this instance, nodes having the same size and configuration can be used in combination with transition pieces to construct the jacket. Such transition pieces (sometimes called "reducers") adapt the standardized dimensions of connection points 58 and 60, 70 or 74, to support members of different (usually smaller) size.

Alternatively, if desired, when constructing jacket assemblies which have smaller support members at the top than at the bottom, nodes having the same geometrical configuration, but constructed of larger or smaller diameter tubes defining connection points of differing size, can be provided. In this instance, nodes made of relatively smaller tubing can be used at the top of the jacket assembly and nodes made of relatively larger tubing can be used at the bottom, with the support members at and between different levels being defined by relatively smaller or larger (or relatively thinner or thicker walled) tubing as desired. This can reduce substantially the number of transition pieces required.

Because all of the nodes of a given jacket assembly, or a series of jacket assemblies, are geometrically similar, the nodes can be manufactured using standardized jigs or the like for holding the node central and first through fourth members in the desired relative positions during welding. The nodes may be fabricated remote from the site of construction of the jacket assembly as such, as at a specialized manufacturing facility where automatic or semiautomatic welding equipment is available. The more complex nodes, therefore, can be assembled under optimum conditions where manufacturing economics and advanced quality control benefits can be realized. Upon shipment of the prefabricated nodes to a shipyard or other place where the jacket assembly is to be assembled, the relatively simpler welds of the respective support members to the node connection points can be made. The result is an economical jacket assembly.

The construction of the jacket assembly includes, if needed, the connection to the jacket assembly per se of suitable pile sleeves and guides, preferably outboard of the basic jacket assembly structure along the main vertical legs 54 of the jacket assembly. Such construction preferably is carried out, as at a shipyard, adjacent a waterway. The jacket assembly preferably is built in a horizontal attitude either on suitable launching skids or, after substantial completion it is placed on suitable launching skids. Piles are then loaded into the pile sleeves and guides, if needed, and are held in position with the lower ends of the piles retracted toward the upper end of the jacket assembly from the lower end of the assembly. Suitable ballast tanks are securely, yet removably, attached to the jacket assembly; the ballast tanks have sufficient positive buoyancy to enable the jacket assembly to float horizontally in the ocean. Also, the ballast tanks are selectively floodable so that the jacket assembly, when disposed in a horizontal floating condition, can be maneuvered to a floating and vertically erect attitude in the ocean. As so defined, the jacket assembly, equipped with piles and ballast tanks, is loaded onto a suitable launch barge.

The leg assembly 25 of production platform 25 may be prefabricated similarly using nodes 50.

By use of tugboats and the launch barge, the prefabricated jacket assembly is moved to the offshore location at which the jack-up platform has previously been positioned. Then, using established launch and ballasting techniques, the jacket assembly is launched from the launch barge into the ocean and moved from a horizontally floating to a vertically floating attitude in the ocean adjacent the drilling operations area of the jack-up platform. Using the tugboats and winches aboard the jack-up platform, the erectly floating jacket assembly is moved to a position below the operative position of the drilling rig; this places the jacket assembly directly over the intended well site. The ballast tanks carried by the jacket assembly are then further ballasted to lower the jacket assembly into engagement with the sea floor. The pilings carried in the jacket assembly piling sleeves and guides are then released and dropped downwardly into the sea floor, thereby to accomplish initial fixing of the jacket assembly from lateral movement on the sea floor.

Figure 2:
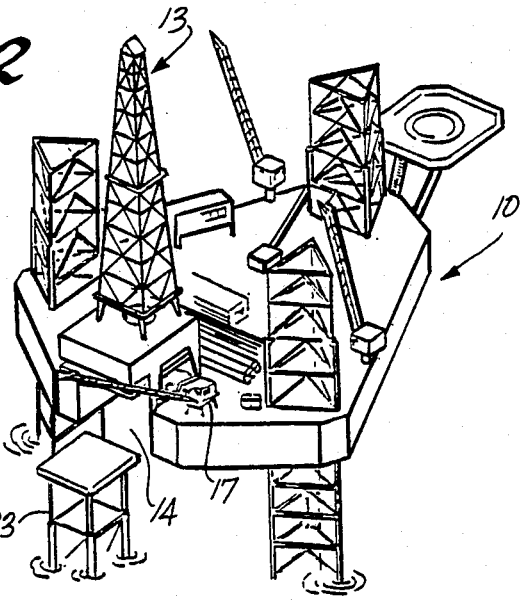
FIG. 2 is a perspective view showing an initial stage in the construction of the facility shown in FIG. 1.

Then, by use of crane 17 on jack-up platform 10 and by use of a pile-driving tool supported by the crane, appropriate additional lengths of piling are added to the piling sections initially carried by the jacket assembly, and such pilings are driven into the sea floor to the desired depth. The driven pilings are then affixed to the jacket assembly, as by the use of conventional grouting techniques, thus to secure the jacket assembly to the sea floor over the submerged location at which one or more wells are to be drilled. This is the state of affairs shown in FIG. 2.

As each well is drilled, it is completed by use of the appropriate equipment.

Next, by use of a crane barge, the completely prefabricated development well deck assembly 24 is moved to the site of the secured jacket assembly. Deck assembly 24 is securely mated to the jacket assembly by use of the crane aboard the crane barge. In this manner, development well platform 20 is defined independently of jack-up platform 10 below the operative position of drilling rig 13 on the jack-up platform. Drilling rig 13 is then moved on the jack-up platform base into its operative position over platform 20 and is used to drill at least one well into the sea floor through the platform.

At any time in the preceding sequence of operations, following the securing of well protector jacket assembly 23 to the sea floor, procedures for placement and completion of production platform 21 can be commenced. Preferably, the procedures for placing and completing the production platform are commenced following mating of wellhead deck assembly 24 to jacket assembly 23 and while drilling operations through the wellhead platform are being carried out.

Leg assembly 25 of production platform 21 is constructed in much the same manner as the construction of jacket assembly 23, and perhaps even at the same onshore construction site. Leg assembly 25 is moved to the vicinity of the jack-up platform on a launch barge. The leg assembly has a length substantially equal to that of jacket assembly 23 as prefabricated. It also includes ballast tanks and initial sections of piling according to the preceding description. The leg assembly is launched from the launch barge to assume a horizontal floating position in the ocean and is then ballasted to assume a vertical attitude while floating. Again, using suitable tugboats and winches aboard the jack-up platform, the floating leg assembly is moved to the desired position adjacent platform 20; this desired position is within the range of crane 17 aboard the jack-up platform. Leg assembly 25 is then ballasted down to engage the ocean floor, the piling sections initially carried by the leg assembly are released to plunge into the upper extent of the sea floor, further piling sections are added as appropriate, and the leg assembly piles are driven the desired depth into the sea floor by use of a pile-driving tool supported by crane 17. When the pile-driving operation is complete, the leg assembly is suitably secured to the piles, as by grouting, using techniques well known in the offshore oil industry.

Production platform deck assembly 26 is then loaded onto a suitable crane barge and moved to the site of the secured leg assembly. By use of the crane aboard the crane barge, the production platform deck assembly is lifted into mating engagement with the upper end of the leg assembly and is then suitably secured to complete the construction, adjacent to the jack-up platform, of a complete production facility equipped to suitably process and treat the gas produced by the wells drilled, being drilled, or to be drilled through platform 20.

The prefabricated bridge assembly 22 can then be lifted by crane 17 from a suitable transit barge into place between platforms 20 and 21. Once the bridge assembly is in place, the wells at platform 20 can be coupled immediately to the production and processing facilities of platform 21.

Upon completion of all wells to be drilled at platform 20, drilling rig 13 is moved from its operative drilling position to its stowed position inboard of base 11 of the jack-up platform. Base 11 can then be jacked downwardly to assume a floating state in the ocean adjacent to platforms 20 and 21, and legs 12 elevated relative to base 11. The jack-up platform is then ready to be towed to another intended well site at the same or a different gas field where it can be placed promptly into service to be used in placing, installing, and completing another set of development well and production platforms according to the procedure described above.

The procedure described above has the feature that jack-up platform 10 is used to perform substantial operations in the installation and completion of platforms 20 and 21 at the desired offshore location. By use of the jack-up platform and the equipment carried thereby, notably crane 17, reliance upon the use of a crane barge is significantly reduced.

Figure 3:
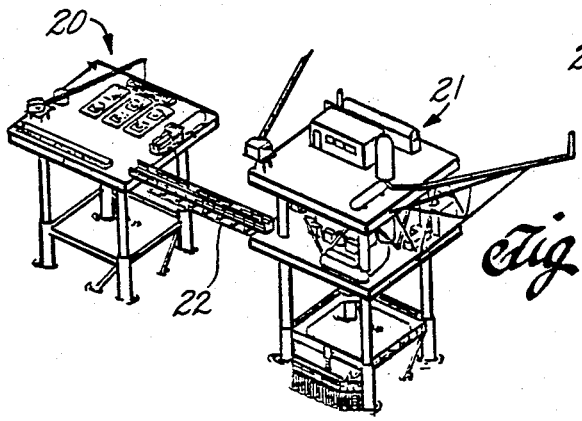
FIG. 3 is a perspective view of the completed facility after removal of the jack-up platform from the vicinity thereof.
Figure 4:
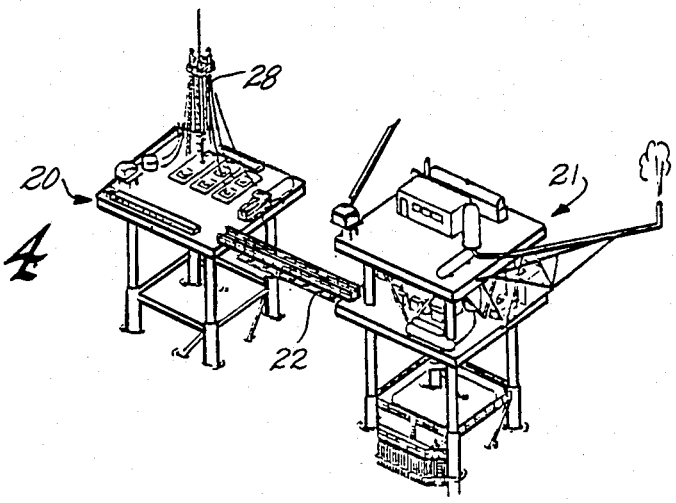
FIG. 4 is a perspective view of the facility showing workover of wells associated with the development drilling platform.

FIGS. 3 and 4 illustrate various stages in the use of the completed offshore production facility after removal of the jack-up platform from the vicinity. FIG. 3 illustrates the use of the facility during normal production circumstances. FIG. 4 shows the facility during workover operations wherein a suitable workover rig 28 has been mounted to platform 20 for workover and service of the several wells previously drilled through platform 20 by use of jack-up platform 10.

The jacket, leg, and deck assemblies of platforms 20 and 21 are of one-design modular nature. The height of the prefabricated jacket and leg assemblies can be varied depending upon water depth and soil conditions; this standardized approach to the design of the jacket and leg assemblies lends itself to prefabrication and reusability of these structures.

Where this invention is to be practiced in the United States Gulf Coast margin area, or in Indonesia, the jack-up platform, the development well platform, and the production platform are designed to withstand applicable environmental criteria including operating temperatures in the range of from 0° to 100° F., water depths of 25 to 150 feet, wind conditions up to 115 miles per hour, and waves having trough-to-crest heights in the range of 40 to 65 feet and periods of from 8 to 12 seconds.

Preferably, production platform deck assembly 26 is prefabricated to have upper and lower decks with a between deck height of 20 feet. The decks preferably are of square configuration, 45 feet on a side. The production deck assembly includes a flare tower 29, the discharge end of which is cantilevered 75 feet to the side of the deck assembly. As prefabricated as a complete unit, the production deck assembly includes substantially all gas or other hydrocarbon treatment and processing equipment. In the presently preferred embodiment of this invention wherein the production platform is designed for use with gas wells, the equipment present on the production deck assembly, at the time of connection of the production deck assembly to its leg assembly, includes suitable inlet manifolds and well heat exchangers, a capacity for storage of 13,500 gallons of diesel fuel, a production separator, a flash tank, a coalescer, a glycol contactor and a glycol heat exchanger, gas and liquid sales metering facilities, an outlet gas control station, a pig launcher, a fuel gas system, a precipitator, a sump, a diesel fire water pump, an instrument air package, appropriate switch gear and a suitable control room, a 150 kw diesel generator, a 150 kw gas generator, a flame scrubber, a 10 ton crane, a glycol reboiler, and either suitable foundations for or complete gas compressors and quarters for six men.

Figure 5:
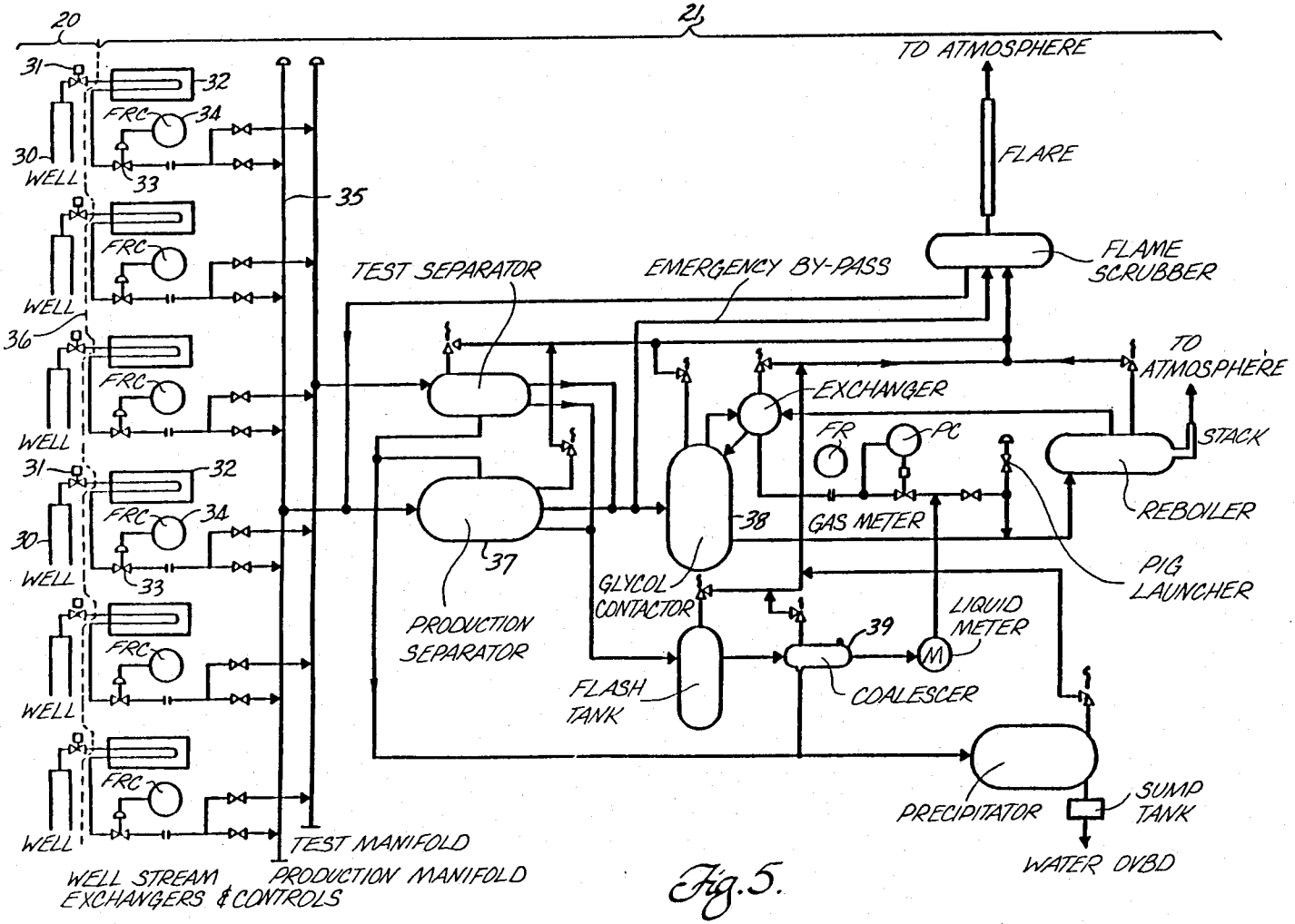
FIG. 5 is a schematic view of the gas processing and treatment system provided in the facility.

The gas processing system provided on the prefabricated production deck assembly is illustrated schematically in FIG. 5. On this system, six individual wells 30 are connected via suitable Christmas trees 31 to individual stream heat exchangers 32, and thence by suitable control valves 33 (operated by appropriate flow rate controllers 34) to a production manifold 35. Broken line 36 in FIG. 5 represents bridge assembly 22.

These gas streams from the several stream heaters 32 are combined via manifold to flow to a single production separator 37 for removal of free water and liquid hydrocarbons. The gas then goes from the production separator to a glycol dehydrator 38 where water is removed to provide product gas of pipeline quality. This gas is then metered and sent, as appropriate, to sales. Hydrocarbon liquids removed from the gas stream are sent to a coalescer 39 for removal of water, following which the hydrocarbon liquid is metered and reinjected into the gas prior to delivery of the gas to sales. The water produced is suitably treated and dumped overboard.

Workers skilled in the art to which this invention pertains will recognize that, while the invention has been described above in the context of a gas development and production facility for a marginal offshore gas field, this invention can be used to advantage in producing petroleum from marginal offshore fields. Similarly, such persons will recognize the manifest advantages and benefits of this invention as applied to offshore petroleum and gas production generally. Accordingly, the foregoing description, which has been presented with specific reference to a presently preferred embodiment of the invention, has been presented for purposes of illustration and example and is not to be interpreted as limiting the scope of this invention to less than the fair scope and meaning of the following claims.

What is claimed is:

1. A method for installing and using an offshore well development platform in water having a depth suitable for use of jack-up drilling platforms, the method comprising the steps of:

(a) providing a jack-up drilling platform having thereon:

(1) a drilling rig having an operative position in a drilling operations area outboard of an elevatable base of the jack-up platform; and (2) a crane on the elevatable base adjacent the perimeter of the base and proximate the drilling rig operative position;

(b) positioning the jack-up platform at an offshore location with the base thereof elevated above the water surface so that the drilling operations area is located vertically over a submerged location on the sea floor at which at least one subsea oil or gas well is to be drilled;

(c) thereafter moving to the offshore location a prefabricated well protector jacket assembly having a length sufficient to extend from the submerged location to above the water surface thereabove, such length being insufficient to extend to the elevation of the drilling rig when the drilling rig is in its operative position;

(d) thereafter setting the well protector jacket assembly in an erect attitude on the sea floor over the submerged location;

(e) thereafter securing the sea jacket assembly to the sea floor over the submerged location by use at least in part, of the jack-up platform;

(f) moving to the site of the secured jacket assembly a prefabricated development wellhead deck assembly matable with the upper end of the secured jacket assembly;

(g) thereafter mating the wellhead deck assembly securely to the jacket assembly below the operative position of the drilling rig, thus to define independently of the jack-up platform a completed development wellhead platform above the water surface and below the operative position of the drilling rig;

(h) thereafter using the drilling rig in its operative position to drill and complete through the wellhead platform at least one well into the sea floor;

(i) at a desired time after performance of step (b) above, moving to the offshore location adjacent the jack-up platform a prefabricated production platform leg assembly having a length substantially equal to that of the well protector jacket assembly;

(j) thereafter, at a desired time after performance of step (e) above, setting the leg assembly in an erect attitude on the sea floor adjacent the secured jacket assembly;

(k) thereafter, securing the leg assembly to the sea floor by use, at least in part, of the jack-up platform;

(l) thereafter, moving to the site of the secured leg assembly a completed prefabricated production platform deck assembly matable with the upper end of the secured leg assembly; and (m) thereafter, mating the production platform deck assembly securely to the production leg platform assembly to define a complete production platform.

2. The method according to claim 1 wherein the steps (i) through (m) are commenced after completion of at least step (c).

3. The method according to claim 1 wherein the performance of at least one of the steps (i) through (m) is commenced during at least part of the performance of step (h).

4. The method according to claim 1, including the further steps of:

(a) installing a bridge between the wellhead platform and the production platform; and (b) connecting each completed well from the wellhead platform to the production platform via the bridge.

5. The method according to claim 4, including the further step, performed after completion at the wellhead platform of all wells to be drilled at the submerged location, of removing the jack-up platform from the offshore location.

6. The method according to claim 1 wherein the step of securing the jacket assembly to the sea floor comprises the further step of driving piles into the sea floor through the jacket assembly by use of a pile-driving tool supported by the jack-up platform crane.

7. The method according to claim 1 wherein the leg assembly is set on the sea floor at a location within the range of the jack-up platform crane, and the step of securing the leg assembly to the sea floor comprises the further step of driving piles into the sea floor through the leg assembly by use of a pile-driving tool supported by the crane.

8. The method according to claim 1, including the further steps of moving the development wellhead deck assembly to the site of the secured jacket assembly by use of a crane barge, and mating the wellhead deck assembly to the jacket assembly by use of the crane barge crane.

9. The method according to claim 1, including the further steps of moving the production platform deck assembly to the site of the secured leg assembly by use of a crane barge, and mating the production deck assembly to the leg assembly by use of the crane barge crane.

* * * * *